US005417371A

United States Patent [19]

Brackett

[11] Patent Number: 5,417,371

[45] Date of Patent: May 23, 1995

[54] FIRE HOSE NOZZLE FOAM EXPANSION APPARATUS

[76] Inventor: Alan C. Brackett, P.O. Box 532, Coloma, Calif. 95613

[21] Appl. No.: 281,762

[22] Filed: Jul. 27, 1994

Related U.S. Application Data

[63] Continuation of Ser. No. 28,305, Mar. 9, 1993, abandoned.

[51] Int. Cl.[6] ..... B05B 1/12

[52] U.S. Cl. ..... 239/391; 239/424.5; 239/428.5

[58] Field of Search ..... 239/390, 391, 397, 428.5, 239/436, 311, 312, 343, 288.5, 399, 424.5; 285/402; 403/325, 327, 87, 104, 108

[56] References Cited

U.S. PATENT DOCUMENTS

| | | | |
|---|---|---|---|
| Re. 20,488 | 8/1937 | Zinkil | 239/428.5 |
| 322,286 | 7/1885 | Hemje | 285/401 X |
| 1,342,912 | 6/1920 | Johnson | 239/391 X |
| 2,660,457 | 11/1953 | Mallon | 285/402 X |
| 2,738,962 | 3/1956 | Goodrie | 239/428.5 X |
| 2,747,931 | 5/1956 | Wilson | 239/428.5 |
| 3,961,754 | 6/1976 | Kuhns et al. | 239/428.5 X |
| 4,518,002 | 5/1985 | Battiston | 403/325 X |
| 4,641,786 | 2/1987 | Moore | 239/600 X |
| 4,730,775 | 3/1988 | Maas | 239/391 X |
| 4,944,460 | 7/1990 | Steingass | 239/428.5 X |
| 5,083,883 | 1/1992 | Ueda et al. | 403/325 X |

*Primary Examiner*—Andres Kashnikow
*Assistant Examiner*—Kevin Weldon

[57] ABSTRACT

A foam generation apparatus for attachment to a terminal portion of a liquid carrying fire hose, and including an outlet nozzle for delivering the liquid in a controllable manner, and which includes a nozzle body movably attached over a center nozzle stem to be manually positionable relative to the stem to allow the liquid to be discharged in a stream of liquid or a fanned spray of the liquid. An expansion chamber support is applied to the exterior of the nozzle body for retaining an elongated foam expansion chamber in a readily detachable manner. Air drawing channels are provided between the expansion chamber support and the expansion chamber to provide for air to be drawn into the expansion chamber from the back end thereof during foam generation. The air drawing channels are positioned in the back end of the expansion chamber adjacent the nozzle so that air is drawn in essentially the same direction as liquid being discharged from the nozzle, and thereby the air is drawn into the expansion chamber early and from the back of the chamber to give sufficient air volume and time for the air to mix with the liquid prior to exiting the elongated expansion chamber. The expansion chamber is readily detachable to allow use of the outlet nozzle in a lighter weight non-foam producing mode, and to allow use of a long expansion chamber relative to the adjustable spray nozzle.

5 Claims, 4 Drawing Sheets

FIRE HOSE NOZZLE FOAM EXPANSION APPARATUS

This is a continuation of application Ser. No. 08/028,305 filed Mar. 09, 1993, now abandoned.

BACKGROUND OF THE INVENTION

1. Field of the Invention

For connection to a hose, usually, but not exclusively a fire hose, a foam generating apparatus, nozzle assembly, and adapter are presented that permit a user to employ a removable foam expansion chamber when desired or needed. More particularly, the subject apparatus relates to a nozzle that is either retrofitted or integrally structured with a rapidly detachable foam expansion chamber that, when attached to the nozzle, allows for the expansion of foam when mixed with indrawn air.

2. Description of the Background Art

The use of fire smothering chemical foams to prevent and terminate fires is well known in the prior art. Such foams are composed of various standard ingredients and are often, though not exclusively, mixed with air to generate an expanded state of the foam.

To deliver water or any other liquid from a transferring hose, the hose is generally fitted with a high pressure nozzle. Often, the nozzle is designed to deliver a variably fanned spray of the liquid. Frequently, only water is pumped or sent in the hose and through the nozzle and at other times only a desired mixture of foam components and water. Therefore, the nozzles currently utilized to deliver fire fighting liquids will differ if essentially pure water is being delivered or if a foaming agent is being transferred.

The core of many traditional variable spray water nozzles has a central stem that is surrounded by an outer nozzle body or bumper and includes means for producing the variable spray. Often, by twisting the nozzle body relative to the stem, or similar means, a fine spray to a more intense stream of water is generated.

For many traditional nozzles delivering foaming agents, the structure generally comprises a non-variable spray system that includes a permanently attached foam expansion chamber or a bulky and cumbersome chamber which is time consuming to add or remove when desired.

Depending on the exact nature of the blaze, the firefighter may need to employ either a stream of liquid or a fine mist of the liquid. For safety reasons, the firefighter may need to spray a widely fanned mist of water into a fire front to help cool the area. This water misting procedure may have to be done very rapidly to achieve the desired safety goal. If a traditional foam delivering nozzle system is employed by a firefighter it is not easy for the firefighter to stop delivering foam and switch to a fine safety mist of water. The subject invention overcomes this difficulty by providing an easily removed foam expansion chamber coupled to a variable spray nozzle, thereby producing a water or foaming agent nozzle in one unit.

SUMMARY OF THE INVENTION

An object of the present invention is to provide a combination water and foam delivering nozzle.

Another object of the present invention is to disclose a combination water and foam delivering nozzle that has a quick release foam expansion chamber.

A further object of the present invention is to produce a combination water and foam delivering nozzle that has a quick release foam expansion chamber that has a release system that is easily utilized by a firefighter wearing gloves and working in darkened or smoky areas.

Still another object of the present invention is to generate an adapter for fitting to a pre-existing fire fighting nozzle that provides a combination water and foam delivering nozzle.

Yet a further object of the present invention is to describe an adapter for fitting to a pre-existing fire fighting nozzle that creates a combination water and foam delivering nozzle that has a quick release foam expansion chamber.

Yet still another object of the present invention is to make an adapter for fitting to a pre-existing fire fighting nozzle that produces a combination water and foam delivering nozzle that has a quick release foam expansion chamber that includes a release system that is easily utilized by a firefighter wearing gloves and working in darkened or smoky areas.

Disclosed is a fire related foam generation apparatus for attachment to a terminal portion of a liquid carrying hose. It is noted that two general embodiments are provided in this disclosure for the subject invention. The first embodiment comprises, in combination, an adapter sleeve and a readily removable foam expansion chamber that fits onto either new or pre-existing fire fighting nozzle cores. The second embodiment comprises a complete nozzle assembly having a nozzle unit with the means for reversibly securing the foam expansion chamber as an integral part of its structure.

Generally, the subject device nozzle comprises a liquid outlet member for delivering the liquid, a foam expansion chamber, and means for releasably securing the foam expansion chamber to the liquid outlet member. In particular, the liquid outlet member comprises a generally tubular adapter sleeve having a central aperture with an outer surface. The foam expansion chamber releasably secures about the adapter sleeve outer surface. A nozzle core is secured within the central aperture with the nozzle core connected to the terminal hose portion.

Additionally, the adapter sleeve further comprises means for drawing air into the expansion chamber. Preferably, vents are suitably positioned in the nozzle adapter sleeve to produce the air draw when the liquid flows.

Usually, the releasable securing means comprises a male means associated with the adapter sleeve for releasably engaging a female means associated with the expansion chamber. More specifically, the male means comprises a securing assembly having a depressible button mounted into the adapter sleeve and the female means comprises, in the expansion chamber, generally, a L-shaped or I-shaped slot terminating in a button engaging orifice. Note that other equivalent slot configurations are considered disclosed by this specification.

Means are provided for generating a variably fanned spray of the delivered liquid. Also, means are included for attaching the nozzle core to the hose.

Generally, the subject device as an integral unit comprises a nozzle assembly that releases a variably fanned spray of the liquid that comprises a nozzle unit having an outer surface and a foam expansion chamber. Provided are means, noted above, for releasably securing the foam expansion chamber to the nozzle unit outer surface. Further, means for drawing air into the foam expansion chamber are included.

Other objects, advantages, and novel features of the present invention will become apparent from the detailed description that o follows, when considered in conjunction with the associated drawings.

DESCRIPTION OF THE PREFERRED EMBODIMENT

Figure 1:
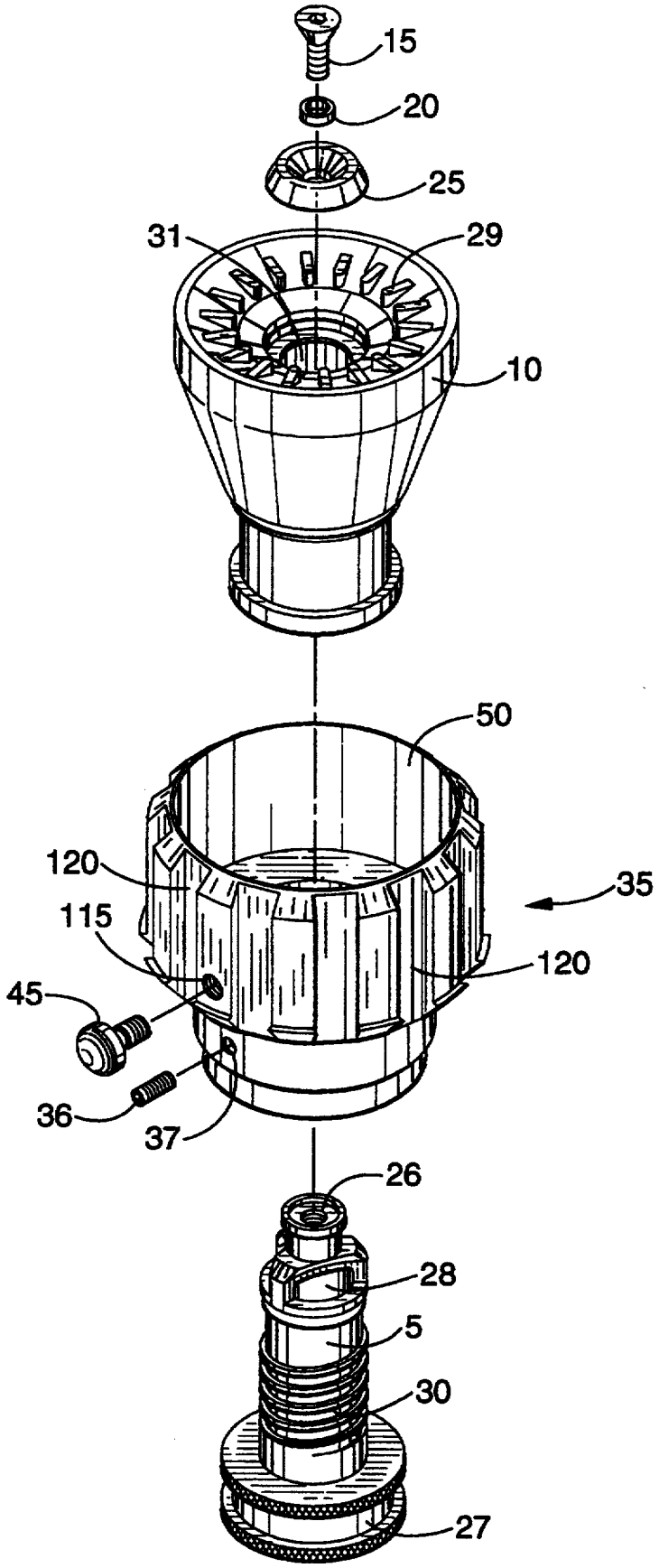
FIG. 1 is an exploded view of a first embodiment of the subject invention without a foam expansion chamber attached.

Referring now to FIGS. 1–5, there are shown first and second preferred embodiments of the subject invention. The subject invention is intended to be produced either in a form that is suitable for retrofitting existing nozzle cores or in a form that includes the elements in an integral nozzle assembly that has no need of retrofitting since it has all of the subject elements present when initially fabricated.

The subject invention may be utilized to retrofit nozzle core structures equivalent to the traditional fire fighting form. Such a traditional nozzle core comprises a central stem 5 fitted within a surrounding nozzle body or bumper 10 and is held in place by retention means often comprising a bolt or screw 15, gasket 20, and retaining ring 25 in which the bolt 15 is received with a threaded aperture 26 (see FIGS. 1 and 3). Further, the traditional nozzle core includes in the stem 5 a hose connector 27 to attach to a terminal portion of a hose and a liquid delivering aperture 28. The liquid delivering aperture 28 interacts with fins 29 on the nozzle body 10 to diffuse the liquid into a spray. A first threaded region 30 on the stem 5 cooperate with a second threaded region 31 within the nozzle body 10 to produce the variably fanned spray by delivering more or less liquid as they twist relative to one another.

It is stressed that the term "nozzle core" is employed in this disclosure to indicate the nozzle structure (stem 5 and nozzle body 10) to be retrofitted with the subject adapter and is distinct from the o term "nozzle assembly", discussed below, which includes the nozzle unit (defined below), foam expansion chamber, and means for securing the foam expansion chamber to the nozzle unit.

Generally, both the first and second embodiments of the subject invention disclose a fire related foam generation apparatus for attachment to a terminal portion of a liquid carrying hose. Comprising the subject device is a liquid outlet member for delivering the liquid, a foam expansion chamber, and means for releasably securing the foam expansion chamber to the liquid outlet member.

Figure 2:
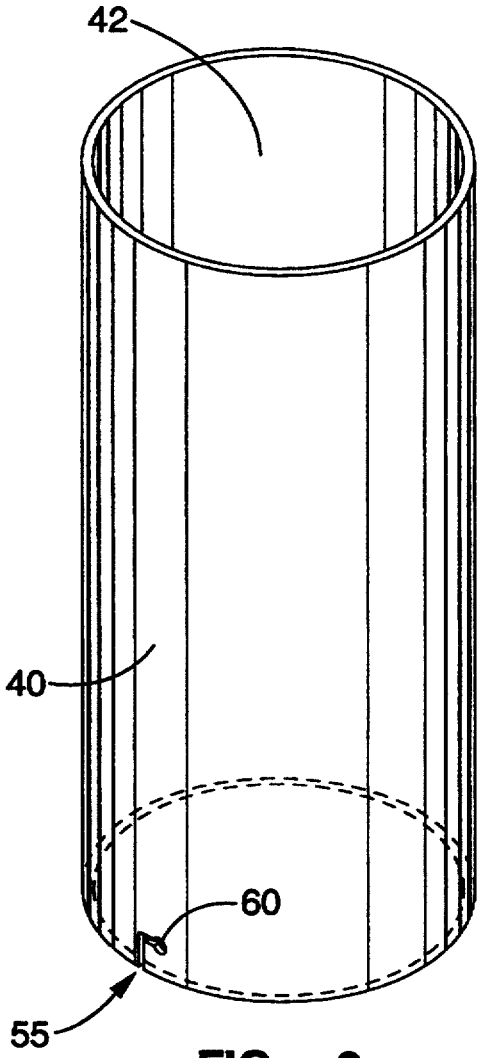
FIG. 2 is a perspective view of the foam expansion chamber of the subject invention.
Figure 3:
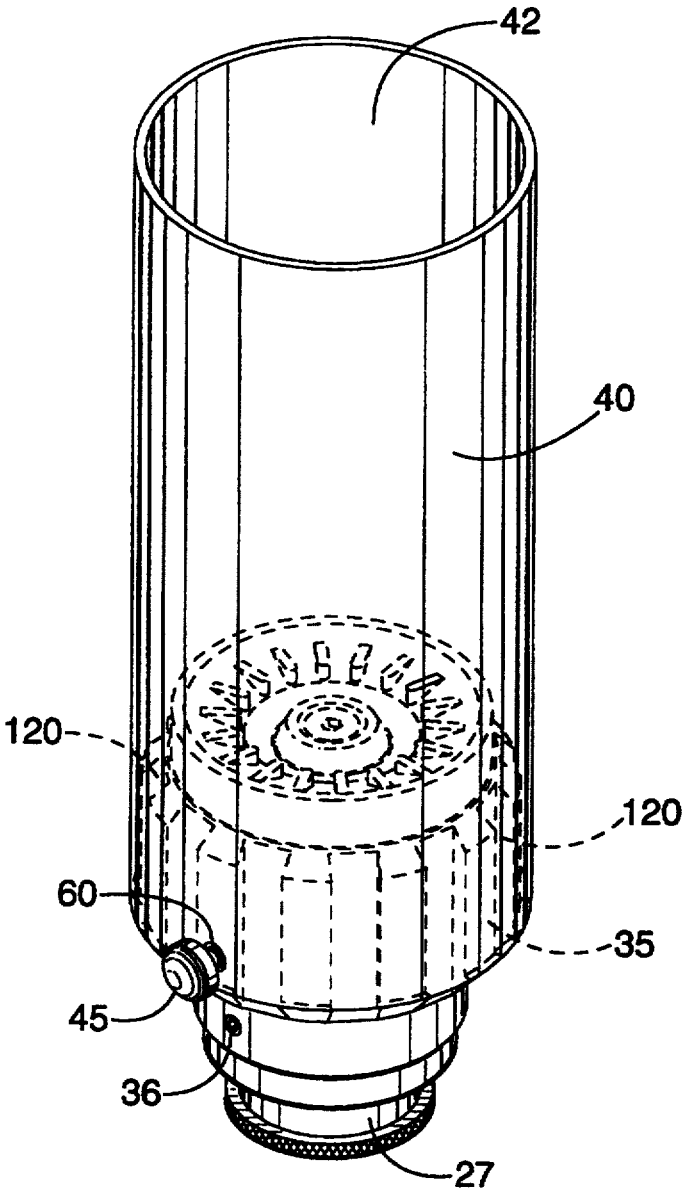
FIG. 3 is a perspective view of the first embodiment of the subject invention with an attached foam expansion chamber.

Specifically, a first embodiment, depicted in FIGS. 1, 2, and 3, relates a nozzle core (combined stem 5 and nozzle body 10) retrofitted with an adapter sleeve 35 that has foam expansion chamber securing means (element 45 in combination with elements 55 and 60) that anchors the foam expansion chamber 40 (see specifically FIG. 2 for the foam expansion chamber). The term "liquid outlet member" is defined to mean the structure generated when a o nozzle core is secured within the generally tubular adapter sleeve 35.

The adapter sleeve 35 has a central aperture 50 and an outer surface. Although the figures indicate that the sleeve 35 is generally tubular, other shapes including cones and the like are considered to be within the realm of this disclosure. The sleeve 35 is anchored to the nozzle body 10 by suitable means such as a least one set screw or bolt 36 running through a receiving orifice 37. The set screw 36 presses on the outer surface of the nozzle body 10 to reversibly secure the sleeve 35 to the nozzle body 10.

The foam expansion chamber 40 is a hollow cylinder, cone, or the like. An internal passage or bore 42 penetrates completely the chamber 40. The diameter (generally between about 2 inches and about 8 inches, although a diameter lesser or greater than these is contemplated as within this disclosure) and length (generally between about 3 inches and about 18 inches, although a length lesser or greater than these is contemplated as within this disclosure) of the chamber 40 are selected to permit proper expansion of the selected foam. Usually, dimensions of the chamber 40 are selected to permit both low expansion (up to about 20 fold expansion) and medium expansion (between about 20 fold and about 200 fold expansion) foams to be utilized with the same expansion chamber 40.

The foam expansion chamber 40 releasably secures about the adapter sleeve's 35 outer surface. Other equivalent means are taken into account, however, a preferred releasable securing means comprises male means 45 associated with the adapter sleeve 35 in releasable cooperation with female means (55 and 60) associated with the expansion chamber 40. More particularly, the female means comprises in the expansion chamber 40 a generally L-shaped slot 55 (as indicated above, other like slot configurations are possible) that enters at one end of the chamber 40 and that terminates in an orifice 60.

Figure 4:
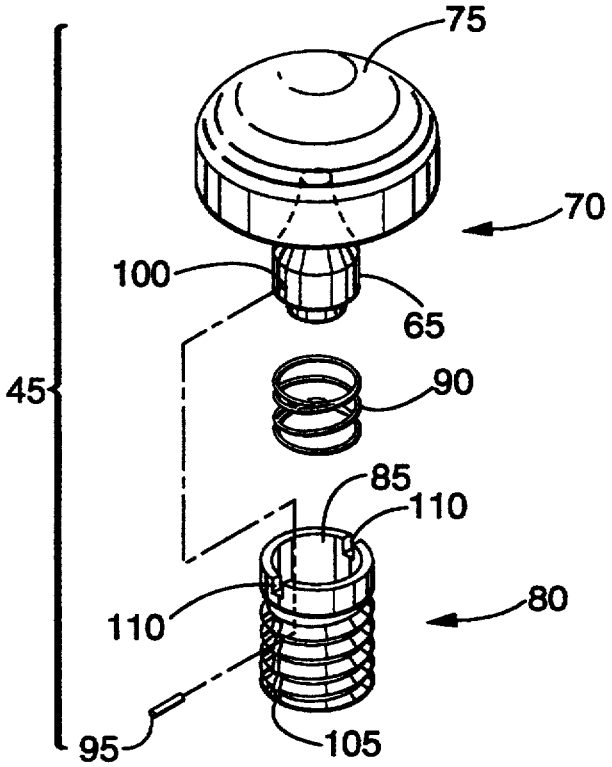
FIG. 4 is an exploded view of a quick release mechanism for the foam expansion chamber of the subject invention.

As seen in FIG. 4, the male securing means 45 comprises, in particular, a plunger 65 connected to a tapered neck 70 which is continuous with a button 75. Further, a receiving cup 80, generally having external threads, has an internal bore 85 for slidably accepting the plunger 65. The internal bore 85 does not completely penetrate the cup 80 but leaves a bottom wall. A resilient member or spring 90 fits below the plunger 65 within the cup and is supported by the cup's 80 bottom wall. The plunger 65 is held under resilient force within the cup 80 by means of a set screw or plug 95 secured in a plug orifice 100 in the plunger 65. When the plunger 65 moves in and out of the cup 80 a central portion of the plug slides within a guide channel 105 that serves to anchor the plunger 65 within the cup 80.

Slots 110 are provided in the cup's 80 top edge for use with an appropriately designed tool that permits the cup's 80 insertion into an accepting cup aperture 115 in the adapter sleeve 35. The cup aperture 115 has threads that mates with the threaded cup 80. When seated within the cup aperture 115, the securing means 45 has a portion of the plunger 65 that extends out past the outer surface of the sleeve 35. To engage the foam expansion chamber 40 securing means the user aligns the chamber 40 over the end of the sleeve 35. Upon rotating the chamber 40, when the slot 55 contacts the portion of the plunger 65 that is extending above the sleeve's 35 outer surface a noticeable click or hesitation is produced. Once this hesitation is detected by the user the button 75 is depressed the chamber 40 fits over the sleeve 35 so that the tapered neck 70 slides within the slot 55. The chamber 40 is twisted to permit the tapered neck 70 to enter the button engaging orifice 60 and the button 75 pressure is released. The upper portion of the plunger 65 slips within the orifice 60 and secures the chamber 40 to the sleeve 35. To remove the chamber 40 the process is essentially reversed. Since firefighters often work in limited light conditions, the mounting and removal process is easily achieved by feel, even with the user wearing protective gloves.

Air drawing channels 120 are formed into the outer surface of the adapter sleeve 35. When the liquid foam composition passes through the nozzle and into an attached foam expansion chamber 40 air is drawn into the chamber 40 through the air vent channels 120. Expanded and expanding foam exits the chamber 40 at the open end and onto a selected target.

Figure 5:
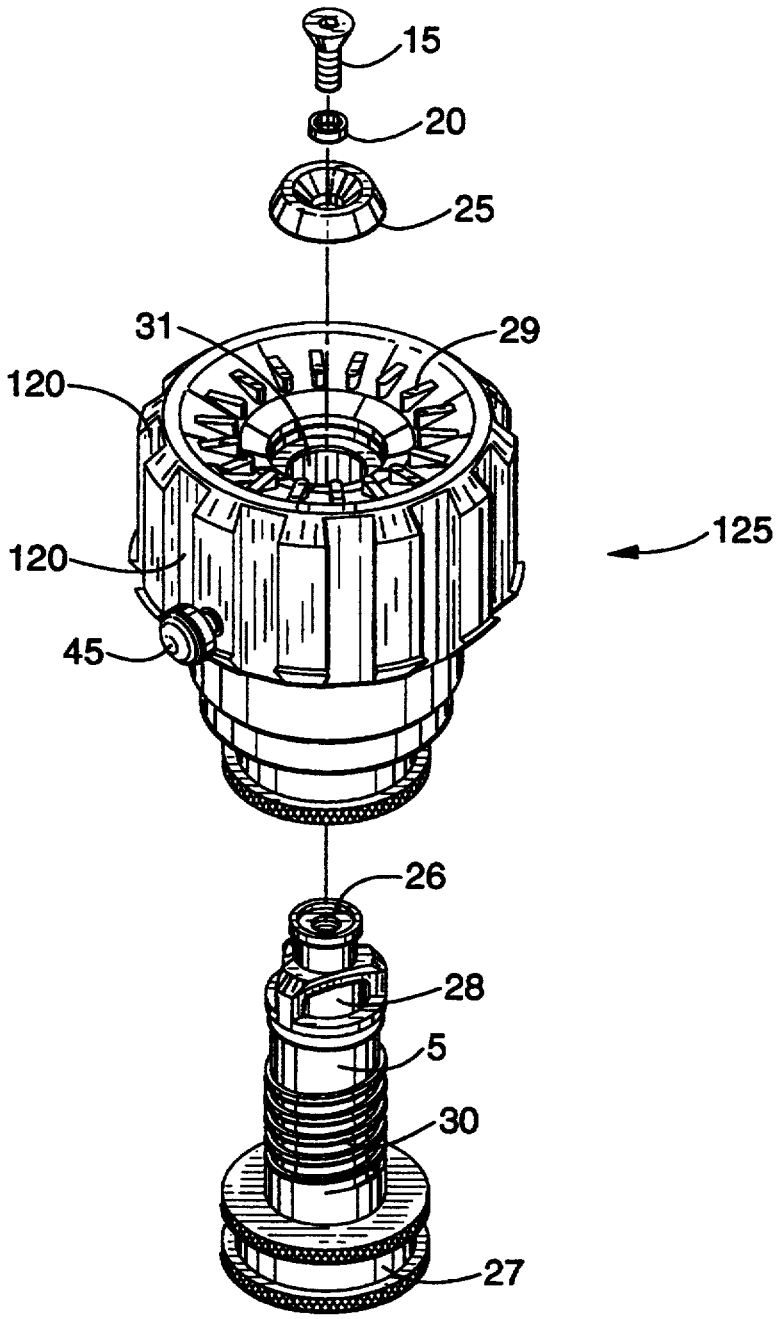
FIG. 5 is an exploded view of a second embodiment of the subject invention without a foam expansion chamber attached.

The second embodiment, illustrated in FIG. 5, discloses a nozzle assembly that is fabricated from elements that are very similar to those presented for the first embodiment described above. Clearly, the essential difference between the first and second embodiments lies in the incorporation into a unified structure of the nozzle body and adapter sleeve. In the subject embodiment depicted in FIG. 5 the "nozzle unit" 125 is a single fabrication and is not intended as an add on or retrofit to an existing nozzle, unless just the stem of an existing suitable nozzle is removed and used with the nozzle unit. Since the nozzle body and adapter sleeve are produced as an intact structure, no first embodiment set screw 36 is needed to anchor the two together.

As with the first embodiment the nozzle body has a foam expansion chamber securing means 45 that releasably attaches the expansion chamber 40 to the outer surface of the nozzle unit 125. Further, identical air vent channels 120 exist in the outer surface of the nozzle unit 125 and draw air under the back edge of the chamber 40 and into the stream of passing liquid.

Appropriate materials are employed to fabricate the subject invention's components. Often aluminum, aluminum equivalent metals or alloys, stainless steel, general metals or alloys, or polymers are utilized to produce the stem 5, sleeve 35, nozzle unit 125, and foam expansion chamber 40. Frequently, the nozzle body 10 consists of both metal and polymeric materials and equivalent substances are acceptable.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. A fire fighting nozzle for attachment to a terminal portion of a liquid carrying hose for receiving liquid from the hose and mixing air with the liquid for generation of fire retardant foam and discharging of the foam in a first mode of operation, and for receiving liquid from the hose and discharging liquid in a second mode of operation, said fire fighting nozzle comprising:

a) a nozzle unit connectable to a liquid carrying hose for delivering liquid received from the hose;

b) said nozzle unit including means for generating a variable spray of the liquid;

c) an elongated tubular foam expansion chamber for use in said first mode of operation;

d) means including a push button lock component for readily releasably securing said foam expansion chamber to said nozzle unit so that said foam expansion chamber is capable of being affixed over said nozzle unit to utilize said fire fighting nozzle in said first mode of operation to generate foam, and said foam expansion chamber can be readily and completely detached from said nozzle unit for the second mode of operation of said fire fighting nozzle; and e) means for drawing air into said foam expansion chamber adjacent said nozzle unit in said first mode of operation so as to provide a major portion of the length of said foam expansion chamber for use as a mixing chamber for mixing air with liquid to create foam prior to the foam being discharged from said fire fighting nozzle, said means for drawing air including a plurality of elongated open channels within an outer body portion of said nozzle unit.

2. A fire fighting nozzle according to claim 1, wherein said means for drawing air into said foam expansion chamber adjacent said nozzle unit includes said plurality of channels defined in said outer body portion of said nozzle unit with said channels opening into a back end of said foam expansion chamber when affixed to said nozzle unit for use in said first mode of operation.

3. An apparatus for attachment to a terminal portion of a liquid carrying fire hose for receiving liquid from the hose and for mixing air with the liquid for generation of fire retardant expanded foam and discharging of the foam in a first mode of operation of said apparatus; and for receiving liquid from the hose and discharging liquid in a second mode of operation of said apparatus, said apparatus comprising, a nozzle core generally comprising a nozzle body engaged about a centrally positioned tubular stem, said tubular stem including a first open end having coupling means for connecting to a terminal end of a liquid carrying fire hose for receiving liquid therefrom, said tubular stem further including a discharge end positioned within a discharge end of said nozzle body at a discharge end of said nozzle core for discharging liquid received from a liquid carrying fire hose, said nozzle body and said tubular stem threadably engaged with one another with the threaded engagement providing means for allowing manual rotation of said nozzle body on said tubular stem for providing variable spray in liquid discharge from said nozzle core, said apparatus further including a tubular adapter sleeve means for allowing removable connection of an elongated foam expansion chamber over the discharge end of said nozzle core, said adapter sleeve means including a central aperture and an outer surface, said adapter sleeve means affixed about said nozzle body with a portion of said nozzle body positioned within said central aperture and the nozzle core discharge end being unobstructed by said adapter sleeve means, the affixment of said adapter sleeve means about said nozzle body including use of at least one fastener for releasably affixing said adapter sleeve means stationary to said nozzle body, said apparatus further including an elongated foam expansion chamber useful in said first mode of operation for generation of a fire retardant expanded foam, said foam expansion chamber comprising an elongated tubular member open through two oppositely disposed ends, means attaching a first of the open ends of said foam expansion chamber about said outer surface of said adapter sleeve means for positioning said foam expansion chamber to receive liquid discharged from said nozzle core, said means attaching said foam expansion chamber to said adapter sleeve means including push button lock means allowing for ready manual detachment and reattachment of said foam expansion chamber relative to said adapter sleeve means for allowing rapid detachment of said foam expansion chamber from said adapter sleeve means for use of said apparatus in said second mode of operation, said apparatus further including open means for introducing air into said foam expansion chamber to be mixed with liquid discharged from said nozzle core within said foam expansion chamber for expanding the liquid into a fire retardant foam, said open means adapted for introducing air into said foam expansion chamber adjacent the discharge end of said nozzle core a substantial distance from an open discharge end of said foam expansion chamber so as to provide a major portion of the length of said foam expansion chamber for use as a mixing chamber for mixing air with liquid, said open means positioned relative to said foam expansion chamber and the discharge end of said nozzle core for introducing air into said foam expansion chamber by drafting created by liquid discharged by said nozzle core into said foam expansion chamber wherein air is drawn into said foam expansion chamber in a generally equal direction of movement of the liquid discharged from said nozzle core.

4. An apparatus according to claim 3, wherein said open means for introducing air into said foam expansion chamber includes a plurality of channels in said outer surface of said adapter sleeve means through which air is drawn into said foam expansion chamber upon and by discharge of liquid from said nozzle core.

5. A foam generation adapter for securing to and retrofitting an existing nozzle core that releases a liquid for converting said existing nozzle core to a foam generating apparatus useful for fighting fires, comprising:

a) an adapter sleeve having a central aperture and an outer surface;

b) means for removably attaching said nozzle core within said adapter sleeve central aperture;

c) an elongated tubular foam expansion chamber;

d) attachment means for readily releasably securing said foam expansion chamber to said adapter sleeve outer surface, said attachment means including a movable male push button lock component mounted by male securing means for securing said push button lock component on said adapter sleeve and positioned for engaging a female slot with orifice in said foam expansion chamber for releasibly engaging said push button lock component;

e) means for drawing air into said foam expansion chamber at an end of said foam expansion chamber positioned adjacent said adapter sleeve so as to provide a major portion of the length of said foam expansion chamber for use as a mixing chamber for mixing air with liquid released by said nozzle core to create foam.

* * * * *